United States Patent [19]

Nantin et al.

[11] Patent Number: 4,792,069

[45] Date of Patent: Dec. 20, 1988

[54] POURING EDGE ON PACKING CONTAINERS

[75] Inventors: Hans Nantin, Trelleborg; Ingemar Ohlsson, Malmö , all of Sweden

[73] Assignee: Tetra Pak International AB, Lund, Sweden

[21] Appl. No.: 106,898

[22] Filed: Oct. 9, 1987

Related U.S. Application Data

[63] Continuation of Ser. No. 880,876, Jul. 1, 1986, abandoned.

[30] Foreign Application Priority Data

Jul. 2, 1985 [SE] Sweden ..... 8503281

[51] Int. Cl.[4] ..... B67D 3/00

[52] U.S. Cl. ..... 222/527; 222/574; 206/633; 229/125.15

[58] Field of Search ..... 222/528, 572, 527, 538, 222/574, 529, 536; 229/125.15; 206/620, 626, 631, 633

[56] References Cited

U.S. PATENT DOCUMENTS

| | | | |
|---|---|---|---|
| 2,820,581 | 1/1958 | Makuta | 222/528 |
| 3,900,155 | 8/1975 | Rausing et al. | 229/17 R |
| 3,977,591 | 8/1976 | Martensson et al. . | |
| 4,101,051 | 7/1978 | Reil | 229/17 R |
| 4,113,103 | 9/1978 | Carlsson | 229/7 R X |
| 4,126,263 | 11/1978 | Martensson | 229/17 R |
| 4,197,949 | 4/1980 | Carlsson | 229/17 R X |
| 4,223,789 | 9/1980 | Reil | 229/17 R X |
| 4,258,876 | 3/1981 | Ljungcrantz | 229/7 R X |
| 4,312,450 | 1/1982 | Reil | 229/7 R X |
| 4,446,971 | 5/1984 | Wise | 229/17 R |
| 4,544,093 | 10/1985 | Stark et al. | 229/43 |
| 4,703,876 | 11/1987 | Reil | 222/572 X |

*Primary Examiner*—Joseph J. Rolla
*Assistant Examiner*—Gregory L. Huson
*Attorney, Agent, or Firm*—Burns, Doane, Swecker & Mathis

[57] ABSTRACT

Pouring edges in the form of projecting material strips are used on packing containers for e.g. liquid foodstuffs. The pouring edge is generally covered by a tear-off cover strip 6 which also serves as a closure for a pouring opening 7. In order to prevent the pouring edge strip 8 from being torn off or deformed at the removal of the cover strip 6, the same is given a z-folded form and is joined to the outside of the packing container in two sealing areas situated at a distance from each other, the doubled area located in between projecting from the packing container and guiding the out-flowing liquid.

9 Claims, 1 Drawing Sheet

POURING EDGE ON PACKING CONTAINERS

This application is a continuation of application Ser. No. 880,876 filed July 1, 1986, now abandoned.

FIELD OF THE INVENTION

The present invention relates to a pouring edge on packing containers of the type manufactured from a flexible packing material and having an upper wall delimited by folding lines and being provided with a pouring opening.

BACKGROUND OF THE INVENTION

On the type of non-returnable packages (for e.g. beverages or other liquid foodstuffs) which are manufactured from plastic-coated paper or other suitable packing laminate a great number of different types of opening arrangements are known which allow the packed contents to be poured from the package. Opening arrangements of the type which comprises a prepared pouring opening and a tear-off cover strip applied over it are frequent. This type of opening arrangement is placed on the top side of the packing container near one of the edges or folding lines which delimit the top side from adjoining side walls. Moreover, the pouring opening, is generally placed near one of the corners of the top side. In spite of this however, difficulties arise when pouring from a newly opened, wholly filled packing container since the contents, as they leave the pouring opening, have a tendency to "adhere to" the outside of the packing material and to run off along the same around the said edge or folding line and along the vertical side wall of the packing container. The problem is aggravated by the fact that in most types of packing laminate the edges present a slightly rounded form and thus do not form any sharply delimited, natural pouring edge which can help to allow the contents to "let go" of the outside of the packing material.

A solution presented earlier (EPO application no. 85200399.5) to overcome this problem makes use of a loose pouring edge strip which is applied to the side of the pouring opening where the contents are intended to run off when the packing container is emptied. By designing the pouring edge strip in a suitable manner and ensuring that it obtains a sharp terminal edge which is separated from underlying packing material very good pouring properties are made possible. However, the directing and the fixing of the pouring edge are difficult to realize on modern packing machines operating at high speed, since the pouring edge is very small and has to be fixed with high precision in order to fulfil its task in a satisfactory manner. This necessitates further working phases which delay the manufacture and complicate further the packing machines used. By joining beforehand the pouring edge to the cover strip and applying these as a unit to the packing container material it becomes possible to apply the pouring edge to the packing container in a simpler manner. This facilitates the manufacture, but it is still difficult to obtain the desired accuracy in the application, since the placing of the pouring edge is very critical if the desired pouring properties are to be achieved. Moreover, owing to its limited size, the pouring edge strip will be endowed with a relatively weak adhesion to the packing material, and it has been found difficult to ensure that the pouring edge will remain on the packing container when the cover strip is removed.

OBJECTS AND SUMMARY OF THE PRESENT INVENTION

It is an object of the present invention to provide a pouring edge previously of the type mentioned in the introduction which is not subject to the disadvantages which affect the pouring edges known and described above.

It is a further object of the present invention to provide a pouring edge which is designed so that it can be sealed to the packing container material in an effective and lasting manner, so that the risk of its breaking loose during handling of the packing container is minimized. The form of the pouring edge strip, moreover, prevents the edge from being unintentionally gripped and removed when the cover strip is torn away in connection with the opening of the packing container.

It is a further object of the present invention to provide a pouring edge of such a shape that the placing of the pouring edge strip can be varied within certain, relatively wide limits without the function of the pouring edge being jeopardized or impaired.

These and other objects have been achieved in accordance with the present invention in that a pouring edge of the type described in the introduction has been given the characteristic that the pouring edge strip is attached to the packing material on the one end between the pouring opening and the adjoining folding line, on the other below the folding line such that the part of the pouring edge strip situated in between forms a projecting pouring edge which extends along the folding line.

Preferred embodiments of the pouring edge in accordance with the invention have been given, moreover, the characteristics which are evident form the subsidiary claims.

The design of the pouring edge strip with two separate sealing areas and a projecting pouring edge in between makes it possible to achieve a secure and durable application which in practice renders impossible an unintentional breaking loose of the pouring edge strip in connection with the removal of the cover strip. Owing to the two sealing areas of the pouring edge strip being placed on either side of the folding line of the packing container a great tolerance in respect of incorrect placing of the cover strip is achieved, since upon folding of the packing material along the folding line the sealing areas will be slightly removed from each other so that the doubled pouring edge is stabilized automatically into a correct, projecting position. If the pouring edge strip is placed in an oblique or displaced manner, the location of the pouring edge will deviate somewhat, but the doubled form causes the pouring edge nevertheless to project sufficiently from the packing container to fulfil its function in a satisfactory manner.

BRIEF DESCRIPTION OF THE DRAWING

A preferred embodiment of the pouring edge in accordance with the invention will now be described in greater detail with special reference to the attached schematic drawing which only shows the details indispensable for an understanding of the invention.

DETAILED DESCRIPTION OF THE PREFERRED EMBODIMENT

Figure 1:
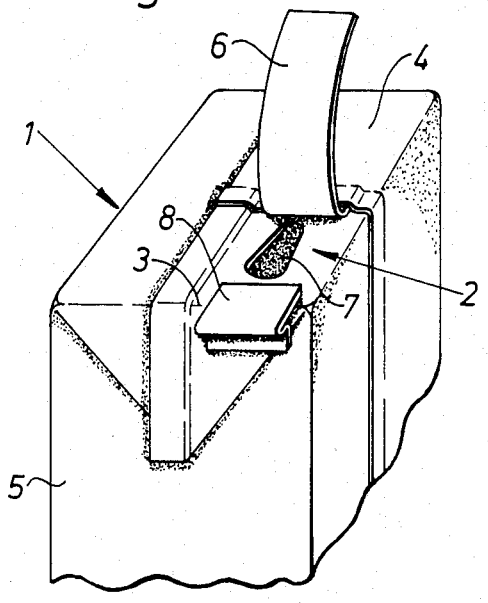
FIG. 1 shows in perspective a part of a packing container with a pouring edge in accordance with the invention.

In FIG. 1 is shown an upper part of a packing container with an opening arrangement and a pouring edge strip in accordance with the invention. The packing container which is of a wellknown type, and is not, therefore, described any further in the present context, is manufactured from a flexible packing laminate which comprises layers of paper and thermoplastics. The laminate is fed in the form of a web to a packing machine, whereafter it is folded into a liquid-tight tube which is filled with the desired contents, e.g. milk. The tube is then processed with the help of sealing jaws which flatten the material tube at equal intervals, so that its walls are in contact with each other in narrow transverse zones. The material is then heated in the said zones with the help of the processing jaws so that the thermoplastic layers fuse together, as a result of which the material tube is divided into liquid-tight packing containers separated from one another. The liquid-tight packing containers thus produced are then severed from one another by transverse cuts in the sealing zones, whereupon they are subjected to a shaping process which converts the cushionlike packing containers into substantially parallelepipedic packing containers of the desired appearance.

As is evident from FIG. 1, the opening arrangement 2 of a packing container 1 is usually placed close to one of the edges or folding lines 3 which delimit the upper side 4 of the packing container from adjoining side walls 5. The opening arrangement 2, similarly to previously known types of opening arrangements, comprises a tear-off cover strip 6 (shown in FIG. 1 in partly removed condition) which covers a pouring opening 7 punched out in the packing material whose shape and size may be adapted to the type of contents for which the packing container is intended. Adjoining the pouring opening 7 is a strip or pouring edge 8 projecting over the adjacent edge line 3 of the packing container 1, which extends from the end of the pouring opening 7 facing towards the folding line 3 and a few millimetres out over the folding line of the packing container.

Figure 2:
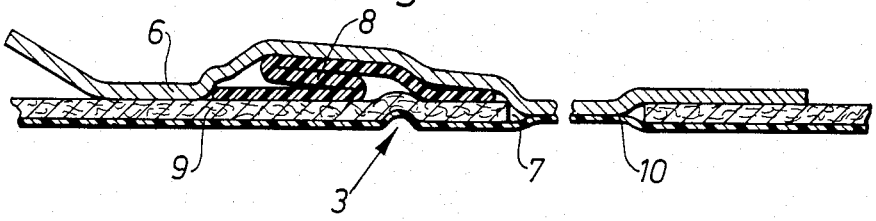
FIG. 2 is a cross-sectional view of an enlarged scale of the packing container material with applied pouring edge strip in accordance with the invention.
Figure 3:
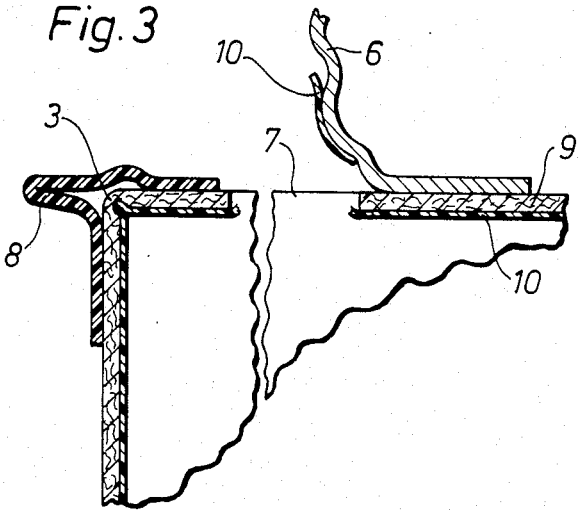
FIG. 3 is a cross sectional view of the packing container along the line 3—3 in FIG. 1; with FIG. 2 after it has been converted to a packing container of the type which is shown in FIG. 1.

The design of the pouring edge 8 and the remaining parts of the opening arrangement are evident more clearly from FIGS. 2 and 3 which in strong enlargement show an opening arrangement of the type shown in FIG. 1 with the packing laminate in a plane, non-folded condition (FIG. 2) as well as when the packing laminate has been converted into a finished packing container (FIG. 3).

The packing container 1 in a conventional manner consists of a laminated packing material which comprises a central carrier layer of paper, one or more thermoplastic layers on either side of the carrier layer and possibly further layers of high gas-tightness, e.g. aluminum foil. However, the packing material may be of a different type, and its design on the whole is without importance for the opening arrangement of the invention, so that the packing material is shown only schematically without the individual layers being indicated. The cover strip 6 applied to the outside of the packing material as a rule also comprises a number of layers, e.g. a layer of aluminum foil and a layer of thermoplastic material facing towards the packing container which is laminated to the aluminum foil.

The pouring edge 8 appropriately also comprises two material layers, namely an outer layer of polystyrene or polyvinyl chloride (PVC) and a layer laminated to the said layer of a material sealable to the outside layer of the packing container, that is to say preferably polythene in those cases where the outside of the packing container is covered with a layer of polythene. Alternatively, the inner layer of the cover strip may consist of ethylene vinyl acetate (EVA) if this is suitable for sealing to the outside of the packing material. It is also possible, of course, to use some form of melting glue (so-called hot melt) or a suitable sealing varnish for joining the pouring edge material to the material of the packing container. The outer layer of polystyrene or PVC may also be coated with a thin cover layer of a seal-controlling varnish. Thus, an easily detachable seal can be accomplished between the pouring edge and the cover strip which is desirable in certain cases explained in more detail in the following. It is evident from the enlarged section through a packing material for the manufacture of a packing container in accordance with FIG. 1 shown in FIG. 2, how the pouring edge strip 8 in z-folded condition is placed against, and is sealed to, the outside of the packing material 9. The two end parts of the z-folded pouring edge strip are sealed to the packing material on either side of the crease or folding line 3, which in the finished condition of the packing container will delimit the upper side 4 of the packing container from the adjoining side wall 5. As a result one sealing area of the pouring edge strip will be joined to the packing material 9 in an area which is located between the pouring opening 7 and the folding line 3, whereas the opposite end of the pouring edge strip 8 will be joined to a part of the packing material 9 situated on the opposite side of the folding line 3. The part of the pouring edge strip situated in between is doubled and partly sealed together and forms a pouring edge extending along the folding line which in the finished and opened condition of the packing container will extend outwardly, substantially in a plane with the upper wall 4 of the packing container (FIG. 3).

FIG. 2 also shows how the cover strip 6 is placed, and sealed to the packing material, in such a manner that it covers the z-folded, underlying pouring edge strip 8 and protects the same against any damage during the handling of the packing material or of the packing container. Within the area of the pouring opening 7 the cover strip is joined, moreover, to a liquid-tight plastic layer 10 which is situated on the side of the packing material facing towards the contents and is sealed to the inside of the packing material in at least one zone extending around the pouring opening 7.

During the conversion of the packing laminate to a packing container a 90° folding of the packing laminate along the folding line 3 take place. A corresponding folding takes place, of course, of the corresponding parts of the pouring edge strip 8 and the cover strip 6. However from this the cover strip 6 and the pouring edge strip 8 on the whole will retain the shape which is shown in FIG. 2. Owing to the folding along the folding line 3, however, the outer surface of the packing material will be stretched slightly in the region of the folding line 3, which means that the two sealing areas of the z-folded pouring edge strip are removed a little further from each other. This increase in the distance between the sealing areas has the consequence that the pouring edge strip 8 in its z-folded state is no longer of sufficient length, but has to be stretched a little, which means that the doubled pouring edge part endeavours to unfold and rise a little from its plane position resting against the packing material. This is counteracted, though, by the cover strip 6 on top, sealed to the packing material.

When the packing container is to be opened, the consumer grips a projecting lug of the cover strip 6 and pulls it in, thereby breaking the join between the cover strip 6 and the side wall 5 of the packing container. The cover strip 6 then no longer maintains the pouring edge strip 8 in position, and the doubled edge part of the latter, owing to the inherent stresses caused in connection with the folding of the packing laminate, will be folded out to the position shown in FIG. 3, that is to say substantially in a plane with the upper wall 4 of the packing container. On continued tearing off of the cover strip 6 the inner layer 10 of the packing material will be broken in the area around the pouring opening 7 and follow the cover strip up, so that the pouring opening is uncovered and the contents can be emptied out through the same. The contents will then run off over the upper part of the pouring edge strip 8 and out over its projecting folded part serving as a pouring edge which guides the contents in a collective jet away from the packing container, so that the contents no longer obtain the tendency of retaining contact with the packing container. The increased distance between the two areas of attachment of the pouring edge strip causes the pouring edge to endeavour to be folded out and to assume the position shown in FIG. 3 which also becomes stable and cannot be affected by external forces. Neither can the material lose its springiness through prolonged storage, since the forces which tend to raise the pouring edge to the desired position are initiated only in connection with the conversion of the packing material to finish packing containers.

The pouring edge strip shown in FIG. 3 is applied in the position which is to be preferred, but it has been found in practical tests that a relatively strong displacement of the points of attachment of the pouring edge strip in relation to the folding line 3 can be tolerated without the projecting pouring edge part assuming such an incorrect position that its function would be jeopardized. If both points of attachment of the pouring edge strip 8 are displaced in the direction away from the pouring opening, the projecting pouring edge will point down a little, but its function nevertheless is satisfactory. In case of displacement in the opposite direction, the pouring edge will point upwards, but even in this position the form and sharp termination of the pouring edge ensure that the contents can be emptied out in the desired manner.

In the manufacture of a packing container with a pouring edge strip in accordance with the invention the packing material is provided with an appropriately placed pouring opening in conventional manner, whereupon the cover strip 6 and the pouring edge 8 are at the same time applied and sealed to the packing material. It is a precondition for this that the cover strip 6 and the pouring edge strip 8 can be handled as a unit, which is made possible by the cover strip and the pouring edge strip being joined detachably to each other by means of a suitable sealing varnish. The pouring edge strip 8 is sealed, like the cover strip 6, to the outer plastic layer of the packing material by means of heat sealing thus providing a seal which is appreciably stronger than the seal between the pouring edge strip 8 and the cover strip 6. In this way it is ensured that the pouring edge 8 does not follow the cover strip 6 when the latter is withdrawn from the packing container in connection with its opening.

By designing the pouring edge strip with two sealing areas, an appreciably more secure attachment is obtained than with the previously known, simple pouring edges which are attached only in the upper area, that is to say between the folding line and the pouring opening. The form moreover ensures that it is not possible to inadvertently get hold of the pouring edge strip when the cover strip is gripped and torn off, and the pouring edge in accordance with the invention has proved in practical tests to fulfill all the requirements regarding function and fixing which might be made in respect of a pouring edge on a modern packing container.

It is, of course, possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations and changes which fall within the range of the claims are intended to be embraced therein.

What is claimed is:

1. A packing container of the type formed of a flexible packing material with an upper wall delimited by folding lines and provided with a pouring opening adjacent one of the folding lines, the packing container including an outer surface provided with a pouring edge assembly comprising:

a pouring edge strip formed of a resilient material and including two opposing ends and at least one strip fold line intermediate the ends, the pouring edge strip being attached to the outer surface of the packing container at a position along a part of the folding line adjacent the pouring opening with one end of the strip being attached to the outer surface of the packing container between the pouring opening and the adjoining folding line and the opposing end of the strip being attached to the outer surface of the packing container below the adjoining folding line, the pouring edge strip being attached to the packing container only at the opposing ends of the pouring edge strip, the strip fold line of the pouring edge strip intermediate the ends defining a projecting pouring edge extending in the direction of the adjoining folding line; and a cover strip closing the opening and covering the pouring edge strip when the packing container is in an unopened condition, the part of the pouring edge strip intermediate the ends being under tension when the packing container is in the unopened condition to create a spreading force on the intermediate part to help force the projecting pouring edge into an outwardly projecting position when the cover strip is removed.

2. A packing container in accordance with claim 1, wherein said pouring edge is folded down and extends along a side wall of the packing container when the container is in an unopened condition.

3. A packing container in accordance with claim 1, wherein said pouring edge extends mainly in a plane with the upper wall of the packing container when the container is opened.

4. A packing container in accordance with claim 1, wherein said pouring edge strip is attached to the cover strip as well as to the packing container by means of seals of different strength, the seal between the pouring edge strip and the cover strip being weaker than the seal betwen the pouring edge strip and the packing material.

5. A packing container in accordance with claim 1, wherein a side of the pouring edge facing towards the packing material consists of a material which can be heat-sealed to the packing material.

6. A packing container in accordance with claim 1, wherein the part of the pouring edge strip situated in between said ends is in the form of a folded strip which unfolds when the packing container is in an opened condition.

7. A packing container in accordance with claim 1, wherein prior to the conversion of the packing material to a packing container said pouring edge strip is in the form of a Z-folded strip having two projecting end parts both of which are attached to the packing material on either side of the folding line adjacent the pouring opening.

8. A packing container in accordance with claim 7, wherein prior to said conversion the packing material is in a plane condition and said pouring edge is folded in a direction away from the pouring opening.

9. A packing container in accordance with claim 7, wherein the Z-folded strip includes Z-fold strip portions that unfold when the packing container is in an opened condition so as to form the projecting pouring edge.

* * * * *